US005797631A

United States Patent [19]

Lander

[11] Patent Number: 5,797,631

[45] Date of Patent: Aug. 25, 1998

[54] BOOK LEAF HOLDER AND MARKER

[76] Inventor: Joel Lander, 5580 E. Second St. #201, Long Beach, Calif. 90803

[21] Appl. No.: 514,008

[22] Filed: Aug. 11, 1995

[51] Int. Cl.[6] ..... B42D 9/00

[52] U.S. Cl. ..... 281/42; 281/45

[58] Field of Search ..... 281/42, 45; 248/448

[56] References Cited

U.S. PATENT DOCUMENTS

| | | |
|---|---|---|
| 400,628 | 4/1889 | Ash . |
| 1,687,438 | 10/1928 | Getz . |
| 3,061,969 | 11/1962 | Lunday . |
| 4,285,532 | 8/1981 | Davis . |
| 4,474,383 | 10/1984 | Kikis . |
| 4,767,094 | 8/1988 | Brown . |
| 5,165,722 | 11/1992 | Wong . |
| 5,165,723 | 11/1992 | Evans . |
| 5,246,251 | 9/1993 | Evans . |

FOREIGN PATENT DOCUMENTS

| | | | |
|---|---|---|---|
| 10512 | 7/1888 | United Kingdom | 281/42 |
| 20366 | 9/1911 | United Kingdom | 281/42 |
| 2055691 | 3/1981 | United Kingdom | 281/42 |

*Primary Examiner*—Frances Han

*Attorney, Agent, or Firm*—Fulwider Patton Lee & Utecht, LLP

[57] ABSTRACT

A book holder having slender fingers affixed to the ends of a telescoping frame serves to hold a book open when the frame is positioned across the back of a book's spine while orientation of the frame along the book's spine allows the device to serve as a book marker when the book is closed. The adjustability of the telescoping frame allows a wide range of book widths and spine lengths to be accommodated.

12 Claims, 2 Drawing Sheets

BOOK LEAF HOLDER AND MARKER

BACKGROUND OF THE INVENTION

1. Field of the Invention

The present invention relates to book holders of the type utilized to hold a book open for convenient viewing by the reader.

2. Description of the Prior Art

Books are typically constructed of multiple leaves bound together and covered by a cover. Books are typically published upon initial introduction in hard cover form and may then later may be published in paper back. Books are read both for pleasure and for research and educational purposes. Often times the reader may give attention to reading a book while performing other tasks such as following reference charts or graphs, performing household tasks or possibly during intermittent breaks in television broadcasts while commercials or the like are shown. Some readers prefer to read during their leisure time such as reclining at the beach or around the pool or even possibly even upon retiring to bed. In many or all such cases readers are faced with the task of holding the book open during the reading process, and particularly for new books, must resist the inherent bias in the spine of a book tending to draw the pages closed, an occurrence which will result in the reader losing his or her place in the book and requiring a momentary search to relocate the point of progress.

Books come in all shapes and sizes and may vary to a great degree in thickness due to the great variation in page numbers. Thus, a need has long existed for a practical holder to fit a wide variety of differently sized and shaped books to temporarily hold the book open while allowing the reader to turn the pages.

In recognition of the need for a practical book holder to hold a book temporarily open during the reading process, many different efforts have been made to provide a practical and inexpensive book holder which can be easily stored and readily available to embrace open books of many sizes and configurations. Examples of prior art book holders are disclosed in U.S. Pat. Nos. 4,932,680; 4,645,236; 4,474,383 and 4,382,617. Many such devices are configured to function from the center of the book, engaging in some manner the book's binding and having a member which spreads the leaves from the center outward. U.S. Pat. No. 4,645,236 to Kemp shows a book page holder formed with a thin, flat single piece of material such as acrylic plastic, with a pair of fork-like fingers at each end. The device is used by inserting it in a clip-like manner in engagement with the leaves of the open book, at the top or bottom of the book, with each pair of fingers acting as a clip. The page holder generally straddles the center binding.

It has been proposed that a book holder be constructed of opposite halves made up of spring wire turned back at the opposite ends in laterally opposite directions to form oppositely oriented hooks so that the mechanism may be twisted against a bias for gripping over the opposite edges of an open book. A device of this type is shown in U.S. Pat. No. 400,628 to Ash. Devices of this type are generally somewhat flimsy and impractical in that, for books open to present different depth stacks on the opposite sides thereof, the bias presented by twisting of the body of the holder is often such that the pressure presented by the hook on the top leaf of a thick stack at one side of the book may be such that the force required to overcome the bias of such hook to draw the leaf to be turned out from under such hook may be so great as to cause the leaf to wrinkle and become permanently creased, torn or otherwise damaged.

U.S. Pat. No. 4,474,383 to Kikis shows a book leaf holder comprising an elongated back member and a page clip at each end of the back member. The holder is constructed of two pieces pivoted together for rotation into a collapse position for the purpose of storage. While offering some advantage for convenient storage, a device of this type suffers the shortcoming that, to be stored, it is disassociated with the book and can easily become misplaced and unavailable the next time the book is to be read.

Other efforts have lead to a proposal where in the device is constructed of flat plastic turned back in a U shape at the opposite end to extend over the opposite edges of an open book for the purpose of trapping the stacked pages of the opposite portions of the open book under the turned back fingers. It has been proposed that a device of this type be constructed of mating telescopical members, either in the form of a tubular track and telescopical slider, or in the form of laterally turned segments formed with slots for telescopical receipt of the strip of the mating member. A device of this type is shown in U.S. Pat. No. 5,246,251 to Evans. Devices of this type, while acceptable for their intended purpose suffer the short coming that their is no practical way to store the holder when the book is closed. Moreover, when the book is open to either the beginning or end of the book the leaf stacks on the thin side of the open book are of uneven depth thus resulting in the leafs of that stack not being effectively trapped under the retaining finger thus leaving the leaves with any degree of bias thereon free to escape from under the finger.

Thus, there exists a need for a book holder that is practical to use for books of different sizes and shapes and which may be conveniently stored on a spine of a book when not in use. The device of this invention solves this problem.

SUMMARY OF THE INVENTION

The book holder of the present invention is characterized by a relatively wide elongated support frame having a rectangular tubular body and a telescopical slider interconnected for longitudinal extension and retraction. Mounted in cantilever fashion on the opposite ends of the support frame are respective, relatively narrow, resilient fingers which project laterally in one direction away from the support frame and then curve proximally inwardly toward one another and then angle proximally and laterally inwardly toward the support frame to terminate in free proximal extremities defining respective pressure pads which may press against the top leaves of the opposite stacks in an open book. Thus, when the book being read is to be held open, the support frame may be placed transversely across the back side of a book and the length thereof adjusted so that the fingers can be received over the opposite edges of the open book with the pressure pads pressed against the top leaves of each stack.

When the holder is to be stored, the support frame may be telescoped longitudinally outwardly to free the respective fingers from the book edges and the support frame then placed longitudinally along the back binding or spine of the book and the fingers flexed laterally outwardly and inserted in the crotch defined between the bases of the open pages of the book and the support frame telescoped longitudinally inwardly to position such fingers between the confronting pages so the book can be closed thereon to trap such fingers in the storage position.

DETAILED DESCRIPTION OF PREFERRED EMBODIMENT

Figure 1:
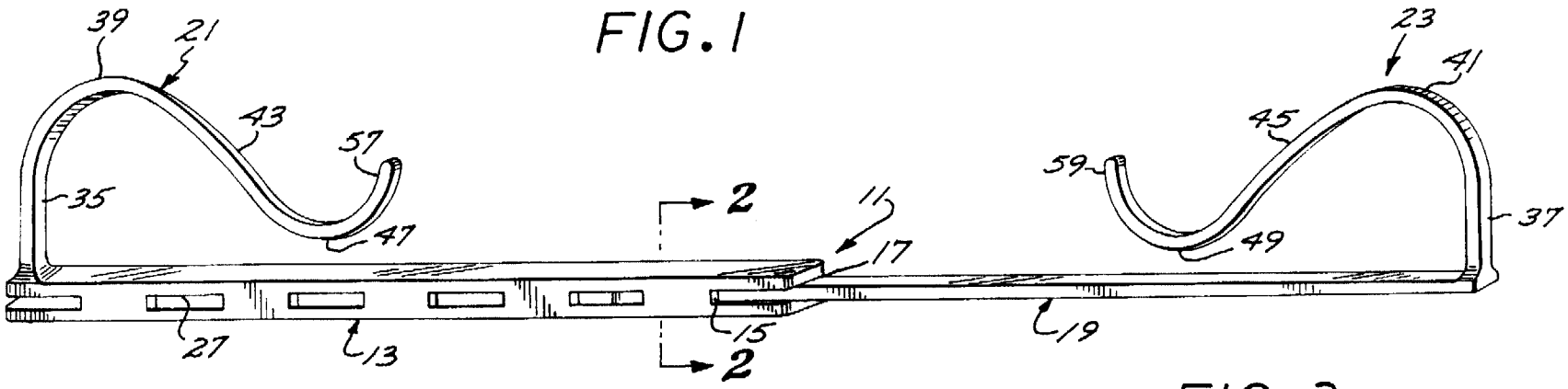
FIG. 1 is a perspective view of a book holder and marker device embodying the present invention.
Figure 4:
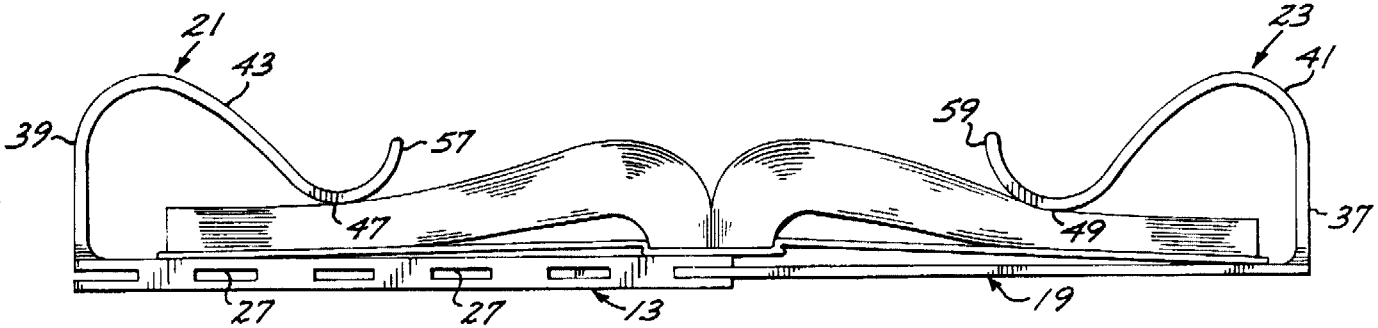
FIG. 4 is a front view similar to FIG. 1, but in reduced scale, and showing the holder holding a book open.
Figure 5:
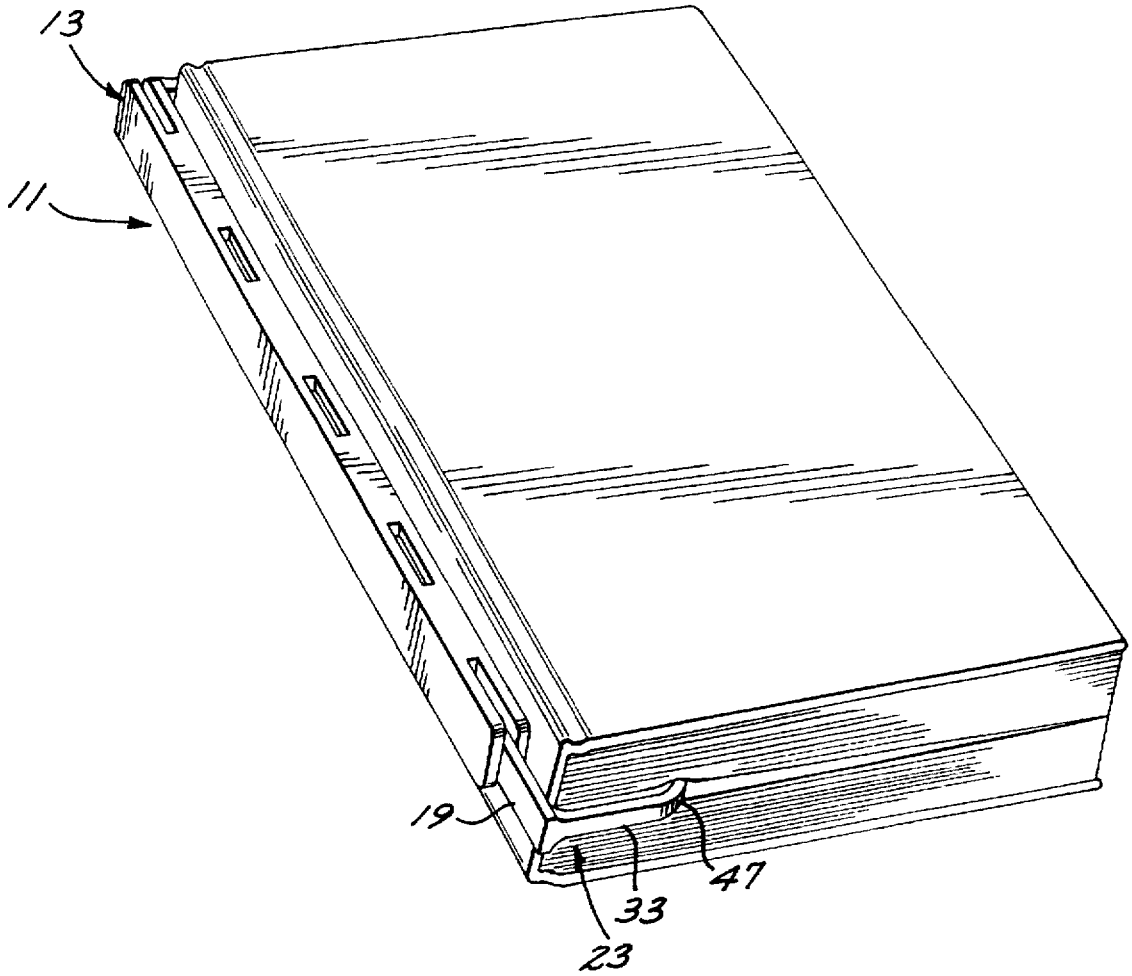
FIG. 5 is a perspective view, in reduced scale, of the holder shown in FIG. 1 mounted to the spine of a book.

Referring to FIGS. 1 & 4, the book holder and marker device of the present invention includes, generally, a support frame 11 formed with a rectangular tubular body 13 defining an elongated open ended track 15 having one end 17 for receipt therein of an elongated slider 19. Mounted at the distal ends of the respective body 13 and slider 19 are respective resilient retainer fingers, generally designated 21 and 23 which are relatively narrow in comparison to the width of the support frame 11 so that they may be fitted over the top and bottom ends of the book's binding as shown in FIG. 5 to be received in the crotch defined between the open pages of the book.

Figure 2:
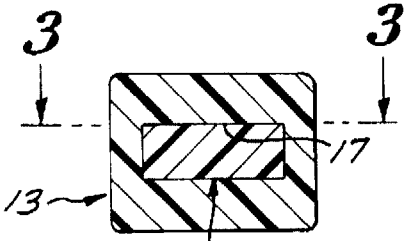
FIG. 2 is a transverse sectional view, in enlarged scale, taken along the line 2—2 of FIG. 1.

In the preferred embodiment, the book holder device of the present invention is constructed of injection molded plastic and is preferably transparent. It may be constructed of polyethylene or acrylic to provide durable construction while having sufficient flexibility to permit the fingers 21 and 23 to be flexed far enough away from the support frame 11 to span the thickness of a stack of leaves about one inch or so thick. The body 13 is generally tubular to form a rectangularly shaped tube (FIG. 2) constructed with the rectangular track 17 open at both ends and is formed in its side walls with longitudinally spaced apart through-slots 27. In the preferred embodiment the body is 6" long, ½ inch wide and ⅜ of an inch thick. The slider 19 is in the form of an elongated strip also about 6 inches long, 11/32 inch wide and ⅛ of an inch thick and is constructed to be received in a gliding slip-fit relationship within the track 17.

Figure 3:
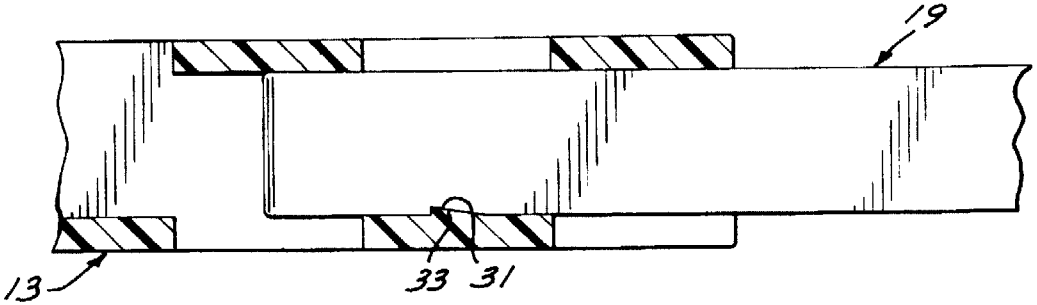
FIG. 3 is a horizontal sectional view taken along the line 3—3 of FIG. 2.

Referring to FIG. 3, the body 13 is formed interiorly adjacent the proximal end 17 with a saw tooth shaped latching tooth 31 and the slider 19 is formed in its adjacent side with a saw tooth-shaped notch 33 for complemental receipt of the tooth 31 so as to, upon extension of the slider 19, make latching engagement to prevent accidental disengagement of the slider 19 from the tubular body 13.

Referring to FIGS. 1 & 4, the fingers 21, 23 are, in practice, of a generally S-shaped configuration and are about ⅛ inch wide. The respective fingers 21 and 23 are constructed with respective laterally projecting stems 35 and 37 which project orthogonal to the axis of the support frame 11 for a distance of about ¾ of an inch and then curve proximally inwardly to define respective transition curves 39 and 41 having a radius of about 0.6 inches. The fingers then angle proximally inwardly and laterally toward the support frame 11 to form respective angular elements 43 and 45. The angular elements angle toward the support frame 11 to form respective close spaced points which define respective pressure pads 47 and 49 spaced about 5/32 seconds of an inch from the top surface of the body 13, or the extended plane thereof, to thus form respective relaxed bights of about 5/32 of an inch. The free extremities then curve upwardly to define respective guide runners 57 and 59 which serve to guide the leaves of the book thereunder. The overall height of the respective fingers from the top surface of the body 13, or extended plane thereof, is about 1½ inches and the total linear length of such fingers from the distal extremities thereof to the most proximal extremities is about 2⅞ inches. It has been found that this configuration provides for ideal performance in conveniently trapping the opposite edges of the book as shown in FIG. 4 and in flexing to be received from the opposite ends of the spine in the crotch of an open book as shown in FIG. 5 for closing of the book thereon to maintain such fingers captive within the book and hold the holder on the back of the spine for storage.

As will be appreciated by those skilled in the art, the book holder device for the present invention may be conveniently molded in two pieces in an injection mold to provide the body 13 with a track 17 of a size and configuration for convenient sliding receipt of the slider 19. The proximate end of the slider 19 may be telescoped into the open proximal end 17 of the body 13 causing the lead end thereof to engage the latch tooth 31 shown in FIG. 3 to push such latch tooth laterally to flex the side walls of the body to the side to enable such tooth to clear the confronting edge of the slider and allow such a slider to travel inwardly within the body 13 to the fully retracted position with the stem 37 of the finger 23 abutted against the proximate end of such body (FIG. 1). Then when the slider is telescoped outwardly to its full extent the tooth 31 will register with the notch 33 to latch such sliders against disengagement from the body.

When a reader desires to use the holder of the present invention, he or she may open the book to the position shown in FIG. 4 and position the holder transversely along the back of such book and telescope the slider 19 to its open position adjusted to the width of the open book. The free extremities of the respective fingers 21 and 23 may be conveniently grasped and shifted laterally outwardly away from the support frame 11 to expand the bight under the pressure pads 47 and 49 to the degree necessary for the required clearance. It will be appreciated that, in practice, the telescopical extension of the support frame 11 may be first established for the width of the particular book and the fingers 21 and 23 flexed to open the respective bights to the extent necessary to freely pass the opposite edges of the book within such bights as the holder is translated either downwardly from the top of the book or upwardly from the bottom of the book. In the alternative, for narrower books, the support frame 11 may be telescoped to its fully extended position and the finger, for instance, 21 flexed to fit over one edge of the open book and the opposite finger 23 then flexed to open the bight sufficiently to be received over the opposite edge of the book, and the slider 19 then telescoped sufficiently far into the body 13 to translate the finger 23 into position over that opposite edge to thereby to allow the finger 23 to be released and press the pad 49 against the top leaf of the stack of leaves on that side of the book.

Then, as the reader commences reading and desires to turn the page of the book, the he or she may contact the page completed with his or her finger to draw the leaf inwardly toward the center of the book to draw the free edge of the leaf from under the pressure pad 49 as viewed in FIG. 4 to thus free that page to be leafed over so the free edge thereof may be inserted gently under the pressure pad 47 of the finger 21. The reader may then progress through the reading of the book in this manner.

Should the reader elect to take a break from reading the book or otherwise elect to store the book for a period of time, it will be appreciated that the device of the present invention may act as a book marker. The fingers 21 and 23 may be flexed to open the respective bights under the pads 47 and 49 so that the holder may be removed from the holding position on the book. The support frame 11 may be aligned longitudinally behind the spine of the book. The slider 19 may be telescoped to its fully extended position. The finger 21 may be flexed to open the bight under the pad 47 to enable the finger 21 to be advanced, for instance, upwardly from the bottom of the spine and into the crotch of the open book to abut the stem 35 against the bottom edge of the book. The upper finger 23 may then be flexed to open the bight under the pad 49 and the slider 19 slid telescopically inwardly to move the finger 23 downwardly from the top edge of the book to be received in the crotch of the open pages. The finger 23 may then be released and the book closed to trap the fingers 21 and 23 to be held captive marking the reader's placed in such book. The reader may then conveniently store the book in a briefcase or a purse or otherwise carry it to a new location with the holder device stored on the spine of the book. The holder will then be conveniently available the next time the reader decides to use it to hold the book open.

From the forgoing it will be apparent that the book holder of the present invention provides a convenient and economical means for holding a book open and for, alternatively, marking the reader's place in the book when it is closed.

To those skilled in the art to which this invention appertains, the above described preferred embodiment is presented by way of preferred example and may, therefore, be subject to change or modification. Such change or modification can be carried out without departing from the scope of the invention, which is intended to be limited by only the scope of the appended claims.

What is claimed is:

1. A book leaf holder and marker device adapted to be stored engaged over the top and bottom edges of a spine of a book and to be removed from said spine to be selectively used to grasp the opposite sides of an open book to hold the book open to selected leaves and comprising:

a support frame including a tubular body formed with an elongated track open at one end and formed at its opposite end with a first distal end;

an elongated slider formed on one end with a slider extremity to be slidably received in said track and on its opposite end with a second distal end; and first and second resilient retainer fingers, no greater than about one eighth inch wide, carried cantileverally from the respective said first and second distal ends and formed with respective stems projecting laterally outwardly away from said support frame and then formed with respective sweeping curves to curve proximally toward one another and to then angle proximally toward one another and laterally toward said support frame to form respective pressure pads confronting said support frame and then projecting proximally and laterally outwardly from said support frame, said fingers having sufficient flexibility to enable said support frame to, with said book open to expose confronting open pages, be positioned along said spine with said fingers aligned with said top and bottom edges of said spine so said fingers can be flexed to space said pads away from said boy to form respective bights and said slider slid into said track to draw said stems toward said top and bottom edges of said spine for receipt of said top and bottom edges on the respective said bights as said fingers are translated between said open pages so said book can be closed to trap said fingers in place to hold said device to said spine.

2. The book leaf holder and marker as set forth in claim 1 wherein:

said support frame is constructed of plastic.

3. The book leaf holder and marker as set forth in claim 1 wherein:

said body is constructed of plastic to form said track open at both ends.

4. The book leaf holder and marker as set forth in claim 1 wherein:

said fingers are configured to project laterally substantially 1½ inches and then project proximally substantially 2⅞ inches.

5. The book leaf holder and marker as set forth in claim 1 wherein:

said fingers are configured to project laterally and curve proximally an a curve having a radius of curvature of about 0.6 inches.

6. The book leaf holder and marker set forth in claim 1 wherein:

said fingers project laterally and then curve proximally laterally toward said support frame to form said pads spaced, with said fingers in their relaxed position, substantially 5/32 of an inch from said support frame.

7. The book leaf holder and marker as set forth in claim 1 wherein:

said tubular body is formed interiorly with a lock tooth projecting laterally into said track;

a locking notch in said slider so configured and positioned as to be selectively engaged by said tooth to limit extension of said slider from said body.

8. The book leaf holder as set forth in claim 7 wherein:

said tooth and notch are constructed with a complemental saw tooth shape.

9. The book leaf holder as set forth in claim 1 wherein:

said body is substantially ½ inch wide.

10. A book leaf holder and marker device adapted to be stored engaged over the top and bottom edges of a spine of a book and to be removed from said spine to be selectively used to grasp the opposite sides of an open book to hold the book open to selected leaves and comprising:

a support frame including a tubular body formed with an elongated track open at one end and formed at its opposite end with a first distal end;

an elongated slider formed on one end with a slider extremity to be slidably received in said track and on its opposite end with a second distal end; and first and second resilient retainer fingers, no greater than about one eighth inch wide carried cantileverally from the respective said first and second distal ends and formed with respective stems projecting laterally outwardly away from said support frame and then formed with respective sweeping curves to curve proximally toward one another and to then angle proximally toward one another and laterally toward said support frame to form respective pressure pads confronting said support frame, said fingers configured to project laterally substantially 1 1/12 inches and then project proximally substantially 2⅞ inches, and having sufficient flexibility to enable said support frame to, with said book open to expose confronting open pages, be positioned along said spine with said fingers aligned with said top and bottom edges of said spine so said fingers can be flexed to space said pads away from said body to form respective bights and said slider slid into said track to draw said stems toward said top and bottom edges of said spine for receipt of said top and bottom edges in the respective said bights as said fingers are translated between said open pages so said book can be closed to trap said fingers in place to hold said device to said spine.

11. The book leaf holder and marker as set forth in claim 1 wherein:

said fingers are formed proximally with respective guides which project beyond the respective said pads to curve proximally and laterally outwardly away from said support frame.

12. A book leaf holder and marker device adapted to be stored engaged over the top and bottom edges of a spine of a book and to be removed from said spine to be selectively used to grasp the opposite sides of an open book to hold the book open to selected leaves and comprising:

a support frame including a tubular body formed with an elongated track open at one end and formed at its opposite end with a first distal end, said tubular body being formed interiorly with a lock tooth projecting laterally into said track;

an elongated slider formed on one end with a slider extremity to be slidably received in said track and on its opposite end with a second distal end, said slider being formed with a locking notch so configured and positioned as to be selectively engaged by said tooth to limit extension of said slider from said body; and first and second resilient retainer fingers, no greater than about one eighth inch wide carried cantileverally from the respective said first and second distal ends and formed with respective stems projecting laterally outwardly away from said support frame and then formed with respective sweeping curves to curve proximally toward one another and to then angle proximally toward one another and laterally toward said support frame to form respective pressure pads confronting said support frame, said fingers having sufficient flexibility to enable said support frame to, with said book open to expose confronting open pages, be positioned along said spine with said fingers aligned with said top and bottom edges of said spine so said fingers can be flexed to space said pads away from said body to form respective bights and said slider slid into said track to draw said stems toward said top and bottom edges of said spine for receipt of said top and bottom edges in the respective said bights as said fingers are translated between said open pages so said book can be closed to trap said fingers in place to hold said device to said spine.

* * * * *

UNITED STATES PATENT AND TRADEMARK OFFICE

CERTIFICATE OF CORRECTION

PATENT NO. : 5,797,631

DATED : August 25, 1998

INVENTOR(S) : Joel Lander

It is certified that error appears in the above-identified patent and that said Letters Patent is hereby corrected as shown below:

Column 6, line 56, delete "1 1/12" and insert --1-1/2--.

Signed and Sealed this

First Day of December, 1998

*Attest:*

*Attesting Officer*

Bruce Lehman

BRUCE LEHMAN

*Commissioner of Patents and Trademarks*